US006953088B2

(12) United States Patent
Rial et al.

(10) Patent No.: US 6,953,088 B2
(45) Date of Patent: Oct. 11, 2005

(54) METHOD AND SYSTEM FOR CONTROLLING THE PRODUCTION RATE OF FLUID FROM A SUBTERRANEAN ZONE TO MAINTAIN PRODUCTION BORE STABILITY IN THE ZONE

(75) Inventors: Monty H. Rial, Dallas, TX (US); Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 85 days.

(21) Appl. No.: 10/328,408

(22) Filed: Dec. 23, 2002

(65) Prior Publication Data

US 2004/0118558 A1 Jun. 24, 2004

(51) Int. Cl.[7] ..... E21B 43/00
(52) U.S. Cl. ..... 166/250.01; 166/64
(58) Field of Search ..... 166/250.15, 251.1, 166/254.2, 270.01, 64, 263

(56) References Cited

U.S. PATENT DOCUMENTS 4,633,954 A * 1/1987 Dixon et al. ..... 166/372
4,685,522 A * 8/1987 Dixon et al. ..... 166/372
5,325,921 A * 7/1994 Johnson et al. ..... 166/280.1
5,441,110 A * 8/1995 Scott, III ..... 166/308.1
5,941,305 A * 8/1999 Thrasher et al. ..... 166/53
6,280,000 B1 8/2001 Zupanick
6,281,489 B1 * 8/2001 Tubel et al. ..... 250/227.14
6,422,060 B1 7/2002 Patashnick et al. ..... 73/28.01
6,476,911 B1 11/2002 Rose ..... 356/337
2003/0221827 A1 12/2003 Brady et al. ..... 166/265
2004/0065439 A1 4/2004 Tubel et al. ..... 166/250.15

FOREIGN PATENT DOCUMENTS

WO WO 01/65068 A1 9/2001

OTHER PUBLICATIONS

Communication in Cases for Which no Other Form is Applicable (1 page), Notification of Transmittal of the International Search Report or the Declaration (1 page), and International Search Report (3 pages), PCT/US 03/38380, mailed Mar. 6, 2004.

* cited by examiner

*Primary Examiner*—Frank Tsay
(74) *Attorney, Agent, or Firm*—Fish & Richardson P.C.

(57) ABSTRACT

A system and method for controlling the production rate of fluid from a subterranean zone includes monitoring a production stream from the subsurface zone for an amount of particulate matter. The rate of the production stream from the subterranean zone is automatically controlled based on the amount of particulate matter in the production stream.

21 Claims, 3 Drawing Sheets

METHOD AND SYSTEM FOR CONTROLLING THE PRODUCTION RATE OF FLUID FROM A SUBTERRANEAN ZONE TO MAINTAIN PRODUCTION BORE STABILITY IN THE ZONE

TECHNICAL FIELD

The present invention relates generally to the recovery of resources from subterranean zones, and more particularly to a method and system for controlling the production rate of fluid from a subterranean zone to maintain production bore stability in the zone.

BACKGROUND

Subterranean deposits of coal, shale and other formations often contain substantial quantities of methane gas. In coal, for example, the methane gas is generally entrained in the coal matrix. Production of the gas typically requires removal of a substantial volume of formation water, which reduces formation pressure and allows the methane gas to disorbe from the coal structure. Methane gas can then be produced to the surface for treatment and use.

SUMMARY

The present invention provides a method and system for controlling the production rate from a subsurface zone to maintain stability of the production bore in the zone. In particular, in accordance with one embodiment of the present invention, the amount of particulate matter dislodged and produced from the subterranean zone is monitored and the production rate of fluids from the zone is controlled to limit formation breakage and/or collapse in the production bore. As a result, maintenance and downtime as well as subsection isolation and resource recovery losses can be reduced and/or limited for a well.

In accordance with one embodiment of the present invention, a system and method for controlling the production rate of fluid from a subterranean zone to maintain stability of a production bore in the zone includes monitoring the production stream from the subterranean zone for particulate matter. The rate of the production stream from the subterranean zone may be automatically controlled based on an amount of particulate matter in the production stream.

Technical advantages of the present invention include providing an automated system and method for controlling production rates from a subterranean zone to maintain the stability of production bores in the zone. In a particular embodiment of the present invention, an amount of a particulate matter in a production stream is monitored and the production rate from the zone adjusted to maintain the amount of particulate matter below a specified level. The specified level may be based on total mass flow of solid particulate matter in the fluid, size of particulate matter and/or ratio of particulate matter to production fluid. As a result, flow restrictions, clogging or other stoppage in the production bore due to dislodged particles may be reduced or eliminated. Accordingly, downtime and re-work of the production well may be reduced and the life of the production pattern extended.

Another technical advantage of the present invention includes providing accelerated production rates from horizontal production bores in delicate formations susceptible to collapse or clogging. In a particular embodiment, the amount of a matter dislodged from the formation and carried in the production stream is monitored and the production rate automatically adjusted to a maximum rate that can safely be accommodated by the production bore. Thus, accelerated revenue streams may be generated from gas productions in coal and other delicate formations with limited risk of damage to the wells.

The above and elsewhere described technical advantages of the present invention may be provided and/or evidenced by some, all or none of the various embodiments of the present invention. In addition, other technical advantages of the present invention may be readily apparent to one skilled in the art from the following figures, descriptions, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
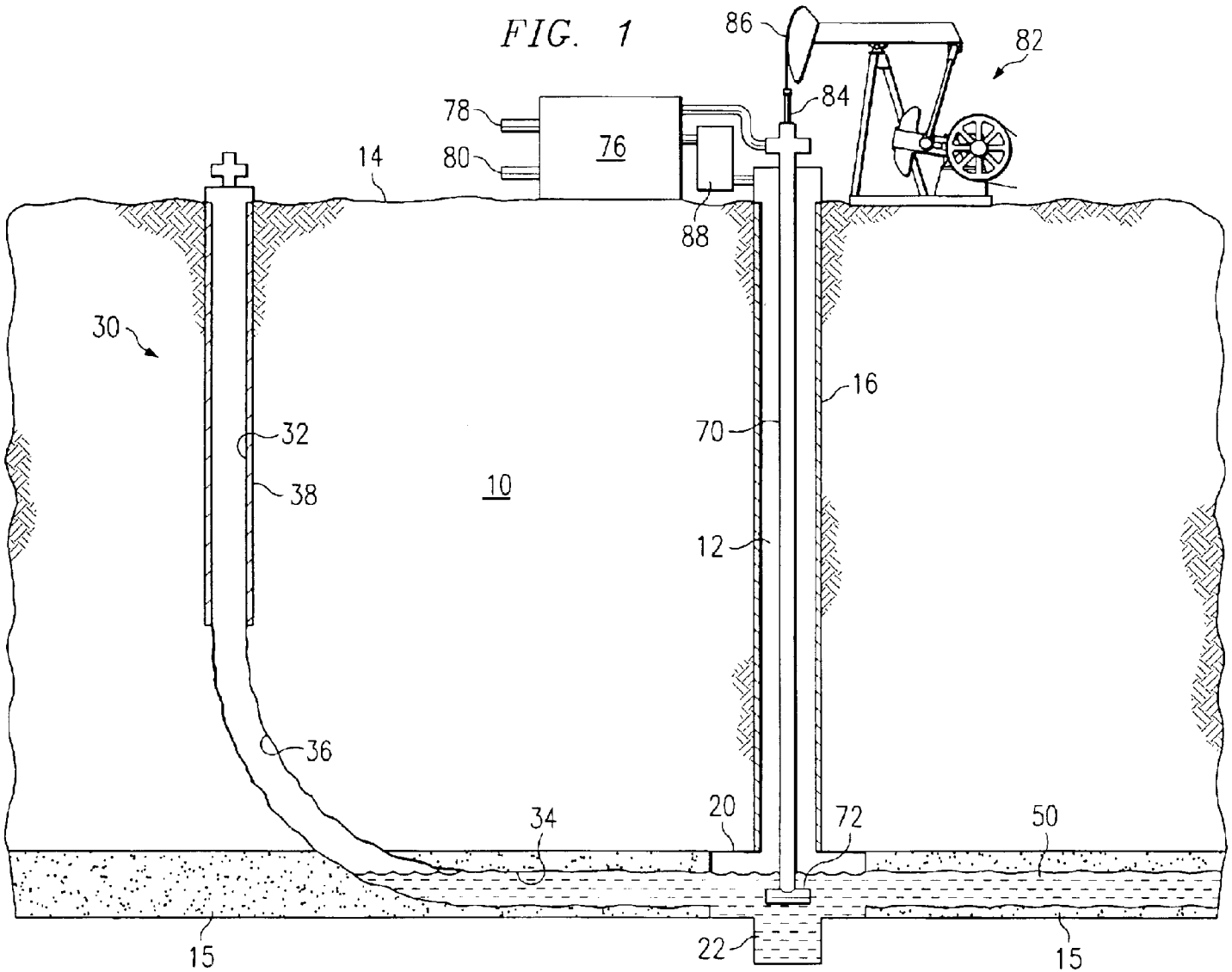
FIG. 1 is a cross-sectional diagram illustrating production from a subterranean zone to the surface using a multi-well system in accordance with one embodiment of the present invention.

FIG. 1 illustrates a multi-well system 10 for production of fluids from a subterranean, or subsurface, zone in accordance with one embodiment of the present invention. In this embodiment, the subterranean zone is a coal seam, from which coal bed methane (CBM) gas, entrained water and other fluids are produced to the surface. Other suitable types of single, dual or multi-well systems having intersecting and/or divergent bores or other wells may be used to access the coal seam or other subterranean zone. In other embodiments, for example, vertical, slant, horizontal or other well systems may be used to access shale or other carbonaceous formations.

Referring to FIG. 1, the multi-well system 10 includes a first well bore 12 extending from the surface 14 to a target coal seam 15. The first well bore 12 intersects, penetrates and continues below the coal seam 15. The first well bore 12 may be lined with a suitable well casing 16 that terminates at or above the level of the coal seam 15. The first well bore 12 is vertical, substantially vertical, straight, slanted and/or non-articulated in that it allows sucker rod, Moineau and other suitable rod, screw and/or other efficient bore hole pump or pumping systems, such as gas lift, to lift fluids up the bore 12 to the surface 14. Thus, the first well bore 12 may include suitable angles to accommodate surface 14 characteristics, geometric characteristics of the coal seam 15, characteristics of intermediate formations and/or may be slanted at a suitable angle or angles along its length or parts of its length. In particular embodiments, the well bore 12 may slant up to 35 degrees along its length or in sections but not itself be articulated to horizontal.

A cavity 20 is disposed in the well bore 12 proximate to the coal seam 15. The cavity 20 may thus be wholly or partially within, above or below the coal seam or otherwise in the vicinity of the coal seam 15. A portion of the well bore 12 may continue below the enlarged cavity 20 to form a sump 22 for the cavity 20. In other embodiments, the cavity 20 may be disposed suitably below the coal seam 15.

The cavity 20 is an enlarged area of one or both well bores 12 and 30 or an area connecting the well bores 12 and 30 and may have any suitable configuration. In one embodiment, the enlarged cavity 20 has a radius of approximately eight feet and a vertical dimension that equals or exceeds the vertical dimension of the coal seam 15. The cavity 20 may provide a point for intersection of the well bore 12 by a second, articulated well bore 30 used to form a horizontal, multi-branching or other suitable subterranean well bore pattern in the coal seam 15. The cavity 20 may also provide a collection point for fluids drained from the coal seam 15 during production operations and may additionally function as a surge chamber, an expansion chamber and the like. In another embodiment, the cavity 20 may have an enlarged substantially rectangular cross section perpendicular to the articulated well bore 30 for intersection by the articulated well bore 30 and a narrow depth through which the articulated well bore 30 passes. In still other embodiments, the cavity 20 may be omitted and the wells may intersect to form a junction or may intersect at any other suitable type of junction.

The second, articulated well bore 30 extends from the surface 14 to the cavity 20 of the first well bore 12. The articulated well bore 30 may include a substantially vertical portion 32, a substantially horizontal portion 34, and a curved or radiused portion 36 interconnecting the portions 32 and 34. The substantially vertical portion 32 may be formed at any suitable angle relative to the surface 14 to accommodate geometric characteristics of the surface 14 or the coal seam 15. The substantially vertical portion 32 may be lined with a suitable casing 38.

The substantially horizontal portion 34 may lie substantially in the plane of the coal seam 15 and may be formed at any suitable angle relative to the surface 14 to accommodate the dip or other geometric characteristics of the coal seam 15. In one embodiment, the substantially horizontal portion 34 intersects the cavity 20 of the first well bore 12. In this embodiment, the substantially horizontal portion 34 may undulate, be formed partially or entirely outside the coal seam 15 and/or may be suitably angled. In another embodiment, the curved or radius portion 36 of the articulated well 30 may directly intersect the cavity 20.

The articulated well bore 30 may be offset a sufficient distance from the first well bore 12 at the surface 14 to permit a large radius of curvature for portion 36 of the articulated well 30 and any desired length of portion 34 to be drilled before intersecting the cavity 20. For a curve with a radius of 100–150 feet, the articulated well bore 30 may be offset a distance of about 300 feet at the surface from the first well bore 12. This spacing reduces or minimizes the angle of the curved portion 36 to reduce friction in the articulated well bore 30 during drilling operations. As a result, reach of the drill string through the articulated well bore 30 is increased and/or maximized. In another embodiment, the articulated well bore 30 may be located within close proximity of the first well bore 12 at the surface 14 to minimize the surface area for drilling and production operations. In this embodiment, the first well bore 12 may be suitably sloped or radiused to accommodate the large radius of the articulated well 30.

A subterranean well bore, or drainage pattern 50 may extend from the cavity 20 into the coal seam 15 or may be otherwise coupled to a surface production bore 12 and/or 30. The drainage pattern 50 may be entirely or largely disposed in the coal seam 15. The well bore pattern 50 may be substantially horizontal corresponding to the geometric characteristics of the coal seam 15. Thus, the well bore pattern 50 may include sloped, undulating, or other inclinations of the coal seam 15.

In one embodiment, the drainage pattern 50 may be formed using the articulated well bore 30 and drilling through the cavity 20. In other embodiments, the first well bore 12 and/or cavity 20 may be otherwise positioned relative to the drainage pattern 50 and the articulated well 30. For example, in one embodiment, the first well bore 12 and cavity 20 may be positioned at an end of the drainage pattern 50 distant from the articulated well 50. In another embodiment, the first well bore 12 and cavity 20 may be positioned within the pattern 50 at or between sets of laterals. In addition, the substantially horizontal portion 34 of the articulated well may have any suitable length and itself form the drainage pattern 50 or a portion of the pattern 50.

Figure 2:
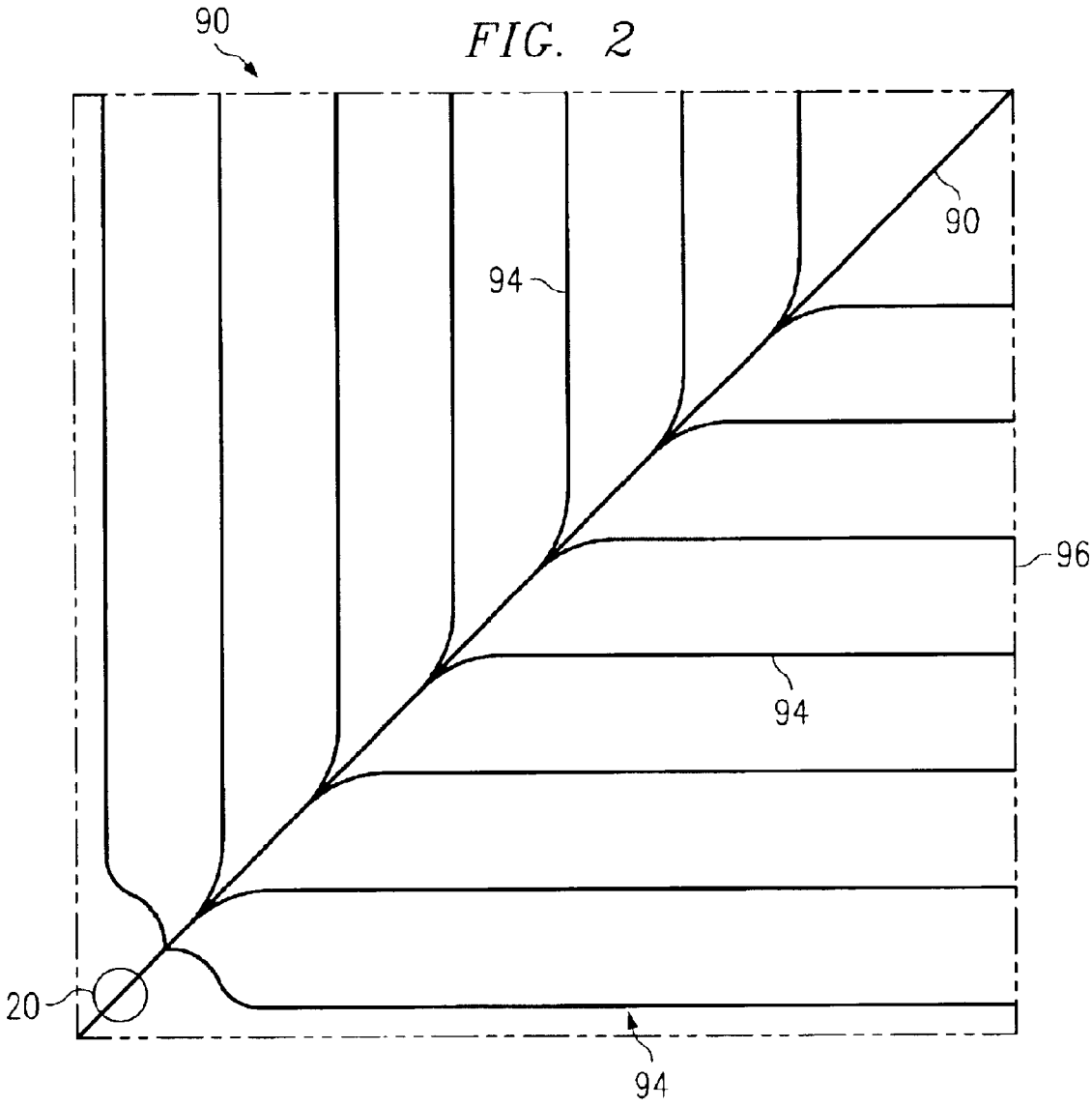
FIG. 2 is a block diagram illustrating a well bore pattern for the multi-well system of FIG. 1 in accordance with one embodiment of the present invention.

The drainage pattern 50 may be a well bore or an omni-directional pattern operable to intersect a substantial or other suitable number of fractures in the area of the coal seam 15 covered by the pattern 50. The omni-direction pattern may be a multi-lateral, multi-branching pattern, other pattern having a lateral or other network of bores or other pattern of one or more bores with a significant percentage of the total footage of the bores having disparate orientations. In these particular embodiments, the well bores of the pattern 50 may have three or more main orientations each including at least ten (10) percent of the total footage of the bores. The drainage pattern 50 may be as illustrated by FIG. 2 a pinnate pattern 90 having a main bore 92, a plurality of laterals 94 and a coverage area 96.

The multi-well system 10 may be formed using conventional and other suitable drilling techniques. In one embodiment, the first well 12 is conventionally drilled and logged either during or after drilling in order to closely approximate and/or locate the vertical depth of the coal seam 15. The enlarged cavity 20 is formed using a suitable under-reaming technique and equipment such as a dual blade tool using centrifugal force, ratcheting or a piston for actuation, a pantograph and the like. The articulated well bore 30 and drainage pattern 50 are drilled using a drill string including a suitable down-hole motor and bit. Gamma ray logging tools and conventional measurement while drilling (MWD) devices may be employed to control and direct the orientation of the bit and to retain the drainage pattern 50 within the confines of the coal seam 15 as well as to provide substantially uniform coverage of a desired area within the coal seam 15.

To prevent over-balanced conditions during drilling of the drainage pattern 50, air compressors may be provided to circulate compressed air down the first well bore 12 and back up through the articulated well bore 30. The circulated air will admix with the drilling fluids in the annulus around the drill string and create bubbles throughout the column of drilling fluid. This has the effect of lightening the hydrostatic pressure of the drilling fluid and reducing the down-hole pressure sufficiently such that drilling conditions do not become over-balanced. Foam, which may be compressed air mixed with water, may also be circulated down through the drill string along with the drilling fluid in order to aerate the drilling fluid in the annulus as the articulated well bore 30 is being drilled and, if desired, as the well bore pattern 50 is being drilled. Drilling of the well bore pattern 50 with the use of an air hammer bit or an air-powered down-hole motor will also supply compressed air or foam to the drilling fluid.

After the well bores 12 and 30, and the drainage pattern 50 have been drilled, the articulated well bore 30 is capped. Production of water, gas and other fluids then occurs through, in one embodiment, the first well bore 12 using gas and/or mechanical lift. In this embodiment, a tubing string 70 is disposed into the first well bore 12 with a port 72 positioned in the cavity 20. The tubing string 70 may be a casing string for a rod pump to be installed after an initial period of gas lift and the port 72 may be the intake port for the rod pump. In this embodiment, the tubing may be a 2 ⅞ tubing used for a rod pump. It will be understood that other suitable types of tubing operable to carry air or other gases or materials suitable for gas lift may be used.

For an initial gas lift phase of production (not shown), an air compressor is connected to the tubing string 70. Compressed air is pumped down the tubing string 70 and exits into the cavity 20 at the port 72. In the cavity 20, the compressed air expands and suspends liquid droplets within its volume and lifts them to the surface. During gas lift, the rate and/or pressure of compressed air provided to the cavity 20 may be adjusted to control the volume of water produced to the surface. In one embodiment, a sufficient rate and/or pressure of compressed air may be provided to the cavity 20 to lift all or substantially all of the water collected by the cavity 20 from a coal seam 15. This may provide for a rapid pressure drop in the coverage area of the coal seam 15 and allow for kick-off of the well to self-sustaining flow within one, two or a few weeks. In other embodiments, the rate and/or pressure of air provided may be controlled to limit water production below the attainable amount due to limitations in disposing of produced water and/or damage to the coal seam 15, well bore 12, cavity 20 and pattern 50 or equipment by high rates of production.

At the completion or in place of gas lift, a pumping unit 82 may be used to produce water and other fluids accumulated in the cavity 20 to the surface. The pumping unit 82 includes the inlet port 72 in the cavity 20 and may comprise the tubing string 70 with sucker rods 84 extending through the tubing string 70. The inlet 72 may be positioned at or just above a center height of the cavity 20 to avoid gas lock and to avoid debris that collects in the sump 22 of the cavity 20. The inlet 72 may be suitably angled with or within the cavity.

The sucker rods 84 are reciprocated by a suitable surface mounted apparatus, such as a powered walking beam 86 to operate the pumping unit 80. In another embodiment, the pumping unit 82 may comprise a Moineau or other suitable pump operable to lift fluids vertically or substantially vertically. The pumping unit 82 is used to remove water and entrained coal fines and particles from the coal seam 15 via the well bore pattern 50.

The pumping unit 82 may be operated continuously or as needed to remove water drained from the coal seam 15 into the enlarged cavity 20. In a particular embodiment, gas lift is continued until the well is kicked-off to a self-sustaining flow at which time the well is briefly shut-in to allow replacement of the gas lift equipment with the fluid pumping equipment. The well is then allowed to flow in self-sustaining flow subject to periodic periods of being shut-in for maintenance, lack of demand for gas and the like. After any shut-in, the well may need to be pumped for a few cycles, a few hours, days or weeks, to again initiate self-sustaining flow or other suitable production rate of gas. In a particular embodiment, the pumping unit 82 may produce approximately eight gallons per minute of water from the cavity 20 to the surface 14.

Once the water is removed to the surface 14, it may be treated in gas/water separator 76 for separation of methane which may be dissolved in the water and for removal of entrained fines and particles. Produced gas may be outlet at gas port 78 for further treatment while remaining fluids are outlet at fluid port 80 for transport or other removal, reinjection or surface runoff. It will be understood that water may be otherwise suitably removed from the cavity 20 and/or drainage pattern 50 without production to the surface. For example, the water may be reinjected into an adjacent or other underground structure by pumping, directing or allowing the flow of water to the other structure.

After sufficient water has been removed from the coal seam 15, via gas lift, fluid pumping or other suitable manner, or pressure is otherwise lowered, coal seam gas may flow from the coal seam 15 to the surface 14 through the annulus of the well bore 12 around the tubing string 70 and be removed via piping attached to a wellhead apparatus. For some formations, little or no water may need to be removed before gas may flow in significant volumes.

The production stream of gas and other fluids and produced particles is fed to the separator 76 through a particulate control system 88. As described in more detail below, the particulate control system 88 may monitor the production stream for an amount of particulate matter and regulate the rate of the production stream, or production rate, of the well 10, based on the amount of particulate matter. The particulate matter may be particles dislodged from the coal seam 15 at the periphery of and/or into the drainage well bores 92 and 94 and/or cavity 20. In this embodiment, maintaining the production rate at a level that can be sustained by the drainage pattern 50 without damage or significant damage may prevent flow restrictions, clogging or other stoppages in the drainage bore 50 and thereby reduce downtime and rework. Isolation of sections of the pattern 50 from production may also be eliminated or reduced.

Figure 3:
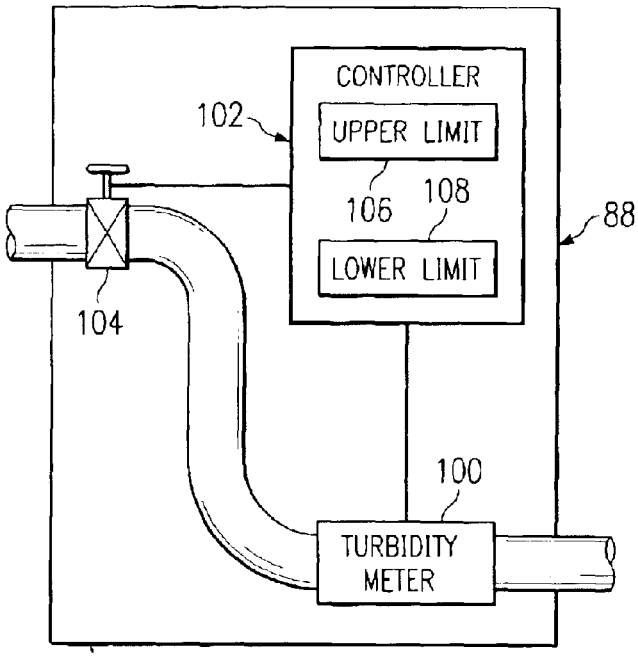
FIG. 3 is a block diagram illustrating details of the particulate control system of FIG. 1 in accordance with one embodiment of the present invention.

FIG. 3 illustrates details of the particulate control system 88 in accordance with one embodiment of the present invention. In this embodiment, the particulate control system 88 is disposed between an outlet of the well head and the separator 76. Components and functionality of the particulate control system 88 may thus be at a centralized surface location. In other embodiments, components and functionality may be distributed between the surface 14 and the cavity 20 or elsewhere in the first well bore 12, drainage pattern 50 or elsewhere, or may be disposed entirely below the surface 14.

Referring to FIG. 3, the particulate control system 88 includes a particulate monitor 100, a controller 102 and an automatic flow control valve 104. The controller 102 may be integral with or remotely coupled to particulate monitor 100 and/or automatic flow control valve 104. The particulate monitor 100, controller 102 and automatic flow control valve 104 may be coupled together and communicate by wired connection, radio frequency (RF) or otherwise. For example, the controller 102 may be remote from the well. In this embodiment, the controller 102 may receive signals from particulate monitors 100 at a plurality of wells 10 and provide flow control to each of the wells 10.

The particulate monitor 100 may be a turbidity meter or other device operable to determine an amount of particulate matter in a fluid stream. The amount may be the presence or absence of particulate matter, the presence of a particular type of particulate matter, the size, volume, mass and/or percentage of the matter and the like. For example, the amount may be measured based on the total mass flow of solid particulate matter in the fluid, the size of particulate matter and/or the ratio of particulate matter to production fluid. As previously described, the particulate matter may be coal or other fragments dislodged from the formation into the drainage bores 92 and 94. For example, coal fragments may dislodge from the top, sides, and/or other part of the drainage bores 92 and 94 due to a pressure differential between the formation and the bores, the volume or velocity of produced water, gas and other fluids, or other conditions.

In a particular embodiment, the turbidity meter 100 measures the amount of particulate matter in Nephelometric Turbidity Units (NTU's) and outputs a signal to the controller 102 indicating the NTU's of the production stream. In this embodiment, the turbidity meter 100 may be a Hach meter. The turbidity meter 100 may be other suitable types of meters operable to indicate the size, mass, volume, percentage or other amount of particulate matter in the production stream. For example, the turbidity or other meter 100 may indicate the amount of particulate matter as low or high or may indicate the amount of particulate matter by only generating a signal in the presence or absence of particulate matter at a specified limit.

The controller 102 is operable to receive the indication of the amount of particulate matter from the turbidity meter 100 and to automatically control the production rate based on the amount. In the illustrated embodiment, the controller 102 controls the automatic flow control valve 104 to maintain the production rate within, above and/or below a specified limit or limits. The controller 102 may drive the automatic flow control valve 104 by incremental adjustments, to specified stops, through the use of Proportional/Integral/Derivative (PID) control algorithms and the like. Control may be automatic in that it is in real-time, in response to real-time conditions or input and/or occurs without direct and/or ongoing run-time operator input.

The controller 102 may comprise logic stored in media. The logic comprises functional instructions for carrying out programmed tasks. The media comprises computer disks, memory or other suitable computer-readable media, application specific integrated circuits (ASIC), field programmable gate arrays (FPGA), digital signal processors (DSP), or other suitable specific or general purpose processors, transmission media, or other suitable media in which logic may be encoded and utilized.

In one embodiment, the controller 102 may include an upper particulate limit 106 and a lower particulate limit 108. In this embodiment, the upper limit 106 may be the maximum amount of matter that can be dislodged into the drainage pattern 50 without risk and/or high risk of adversely affecting the drainage pattern 50. The lower limit 108 may be an amount of particulate matter that indicates the production rate can be safely increased without risk and/or high risk of adverse effects to the drainage pattern 50. In a specific embodiment, the upper limit 106 may be 20,000 NTUs and the lower limit 108 may be 1,000 NTUs. Other suitable limits, a single or other plurality of limits may be used by the controller 102.

The automatic flow control valve 104 may be any suitable valve and/or device operable to be adjusted to control the rate of the production stream. In one embodiment, the automatic flow control valve may be a Kim Ray Motor Valve valve. In this and other embodiments, the controller 102 may open the valve 104 to increase the rate of production from the coal seam 15 if the amount of particulate matter is below the lower limit 108. Conversely, the controller 102 may close the valve 104 to decrease the production rate if the amount of particulate matter is above the upper limit 106.

Figure 4:
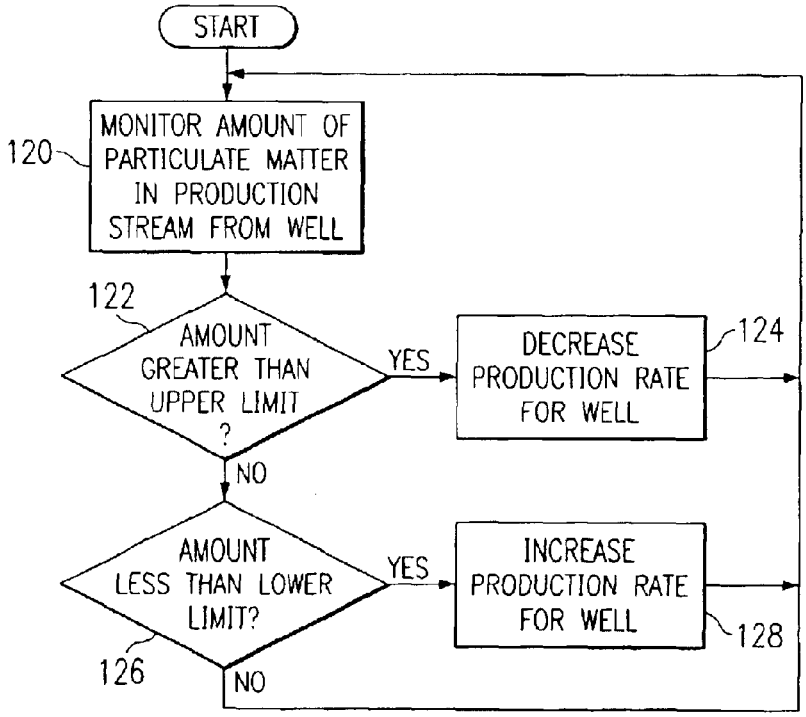
FIG. 4 is a flow diagram illustrating a method for automatically controlling the rate of production from a subterranean zone to maintain stability of the production bore in the zone.

FIG. 4 illustrates a method for automatically controlling the rate of production from a subterranean zone to maintain stability of the production bore in the zone in accordance with one embodiment of the present invention. In this embodiment, production is maintained between a specified upper and lower limit. The specified limits may be predefined or determined in real-time based on operating parameters for the well. The specified limits may also be manually entered and/or adjusted. Further, in other embodiments, production may be maintained below an upper limit or may be maintained at or about a single limit.

Referring to FIG. 4, the method begins at step 120 in which the amount of particulate matter in a production stream of a well is monitored. As previously described, the amount of particulate matter may be monitored by the turbidity meter 100. In this embodiment, the turbidity meter 100 may indicate the amount of particulate matter to the controller 102.

Next, at decisional step 122, it is determined whether the amount of particulate matter is greater than an upper limit. The determination may be made by the controller 102 based on input from the turbidity meter 100. If the amount of particulate matter is greater than the upper limit, the Yes branch of decisional step 122 leads to step 124. At step 124, the production rate for the well is decreased. In one embodiment, the controller 102 may decrease the production rate for the well by adjusting the automatic flow control valve 104. The adjustments may be incremental or to a specified stop.

Returning to decisional step 122, if the amount of particulate matter in the production stream is not greater than a specified limit, the production rate is not likely and/or seriously damaging the production bores through which fluids flow, are collected and produced and the No branch of decisional step 122 leads to decisional step 126. At decisional step 126, it is determined whether the amount of particulate matter is lower than a lower limit. If the amount of particulate matter is lower than the lower limit, then the production rate can be raised without damage and/or high risk of damage to the production bore and the Yes branch of decisional step branch 126 leads to step 128. At step 128, the production rate for the well is increased. In one embodiment, the controller 102 may increase the production rate for the well by adjusting the automatic flow control valve 104.

Returning to decisional step 126, if the amount of particulate matter is not less than the lower limit, the amount of particulate matter is within the acceptable range and the No branch of decisional step 126 returns to step 120 where the production stream is monitored. The production stream may be continuously, periodically or otherwise monitored. Steps 124 and 128 also return to step 120 for continued monitoring of the production stream for particulate matter. In this way, the production rate for the well is maximized up to a bore hole's known, estimated or modeled stability limit.

Although the present invention has been described with several embodiments, various changes and modifications may be suggested to one skilled in the art. For example, a flow meter may be used in place of the particulate monitor and flow limit(s) established based on well bore modeling, historic data and the like. In this embodiment, flow over a specific upper limit may cause the controller 102 to decrease the production rate by adjusting closed the automatic flow control valve 104. Conversely, a low flow rate may cause the controller 102 to increase the production rate by adjusting open the automatic control valve 104. In still other embodiments, other types of devices that monitor a characteristic of the production stream that indicates or can be correlated to well bore stability may be used in connection with the controller 102 and automatic flow control valve 104. It is intended that the present invention encompass such changes and modifications as fall within the scope of the appended claims and their equivalence.

What is claimed is:

1. A system for automatically controlling the production rate fluid from a subterranean zone, comprising:

a particulate monitor operable to monitor a production stream from a subterranean zone for a presence of particulate matter and to output a signal indicative of the amount of particulate matter in the production stream; and a control system coupled to the particulate monitor, the control system operable to receive the signal output from the particulate monitor and to automatically control a rate of the production stream from the subterranean zone based on the amount of particulate matter in the production stream.

2. The system of claim 1, wherein the subterranean zone comprises a coal seam.

3. The system of claim 1, further comprising a control valve operable to regulate the rate of the production stream, wherein the control system is operable to automatically control the rate from the subterranean zone by controlling the control valve.

4. The method of claim 1, wherein the particulate monitor comprises a turbidity meter.

5. The system of claim 1, wherein the particulate monitor and control system are positioned at the surface.

6. The system of claim 1, wherein at least one of the particulate monitor and control system are positioned below a well head.

7. The system of claim 1, further comprising a horizontal production bore in the subterranean zone, the particulate matter in the production stream comprising matter dislodged from the subterranean zone into the horizontal production bore.

8. The system of claim 7, further comprising a plurality of lateral well bores coupled to the horizontal production bore in the subterranean zone, the particulate matter in the production stream comprising matter dislodged from the subterranean zone into the horizontal production bore and the lateral well bores.

9. The system of claim 1, the control system operable to automatically decrease the rate of the production stream from the subterranean zone if the amount of particulate matter in the production stream is greater than a limit.

10. The system of claim 1, the control system operable to automatically increase the rate of the production stream from the subterranean zone if the amount of particulate matter in the production stream is less than a limit.

11. The system of claim 9, wherein the limit comprises 20,000 NTUs.

12. A method for controlling the production rate of fluid from a subterranean zone, comprising:

monitoring a production stream from a subterranean zone for an amount of particulate matter; and automatically controlling a rate of the production stream from the subterranean zone based on the amount of particulate matter in the production stream.

13. The method of claim 12, wherein the subterranean zone comprises a coal seam.

14. The method of claim 12, wherein the subterranean zone comprises a carbonaceous formation.

15. The method of claim 12, further comprising using a turbidity meter to monitor the production stream for the amount of particulate matter.

16. The method of claim 12, further comprising automatically adjusting a control valve for the production stream to control the rate of the production stream from the subterranean zone.

17. The method of claim 12, further comprising monitoring at the surface the production stream from the subterranean zone for particulate matter.

18. The method of claim 12, further comprising collecting fluids forming the production stream from a multi-lateral pattern in the subterranean zone.

19. The method of claim 12, further comprising automatically decreasing the rate of the production stream from the subterranean zone if the amount of particulate matter in the production stream is above a limit.

20. The method of claim 12, further comprising automatically increasing the rate of the production stream from the subterranean zone if the amount of particulate matter in the production stream is below a limit.

21. A system for controlling the production rate of fluid from a subterranean zone, comprising:

means for monitoring a production stream from a subterranean zone for an amount of particulate matter; and means for automatically controlling the rate of the production stream from the subterranean zone based on the amount of particulate matter in the production stream.

* * * * *